US008668629B2

(12) United States Patent
Tamari

(10) Patent No.: US 8,668,629 B2
(45) Date of Patent: Mar. 11, 2014

(54) MULTIMODE EXERCISE DEVICE

(76) Inventor: Ran Tamari, Hod-Hasharon (IL)

( * ) Notice: Subject to any disclaimer, the term of this patent is extended or adjusted under 35 U.S.C. 154(b) by 322 days.

(21) Appl. No.: 13/090,271

(22) Filed: Apr. 20, 2011

(65) Prior Publication Data

US 2011/0263388 A1 Oct. 27, 2011

Related U.S. Application Data

(60) Provisional application No. 61/326,235, filed on Apr. 21, 2010.

(51) Int. Cl.
*A63B 22/00* (2006.01)
*A63B 22/06* (2006.01)

(52) U.S. Cl.
USPC ..... 482/57; 482/51

(58) Field of Classification Search
USPC ..... 482/51–54, 57–65, 70–71, 130; 601/23, 601/33–36; 74/10.8, 10.45, 74, 89.16, 417, 74/396, 397
See application file for complete search history.

(56) References Cited

U.S. PATENT DOCUMENTS 5,529,555 A * 6/1996 Rodgers, Jr. ..... 482/57
6,551,218 B2 * 4/2003 Goh ..... 482/52
6,605,021 B2 * 8/2003 Kobayashi et al. ..... 482/57

* cited by examiner

*Primary Examiner* — LoAn Thanh
*Assistant Examiner* — Rae Fischer
(74) *Attorney, Agent, or Firm* — Soroker-Agmon

(57) ABSTRACT

A multimode exercise device, including: a chassis with two opposing elongated sides; an exercise mechanism mounted onto the chassis comprising on each side of the chassis: a slidable assembly that is configured to move backward and forward along one elongated side of the chassis; a rotatable wheel configured to rotate about an axis at its center and mounted onto the slidable assembly; a pedal coupled to the rotatable wheel configured to rotate the rotatable wheel; a restraining rod that is rotatably coupled to a side of the chassis on a first end and rotatably coupled to the rotatable wheel at one of a plurality of user selectable attachment positions on the second end; a synchronizing mechanism to synchronize between the rotations of the rotatable wheels on both sides of the chassis.

10 Claims, 10 Drawing Sheets

MULTIMODE EXERCISE DEVICE

RELATED APPLICATIONS

This application claims priority from U.S. provisional application No. 61/326,235 filed on Apr. 21, 2010, the disclosure of which is incorporated herein by reference.

FIELD OF THE INVENTION

The present invention relates generally to an exercise machine and more specifically to a multimode exercise machine.

BACKGROUND OF THE INVENTION

Various types of exercise equipment are used for performing indoor aerobic exercise. Different devices emulate different types of activities and stimulate different muscles, for example one device emulates cross country skiing by simulating the gliding motion of cross country skiing. Another device enables stationary bicycling, and other devices emulate elliptical motion.

Each device stimulates different sets of muscles therefore it is desirable for a person to use different exercise devices for selected time intervals to strengthen different muscles, for example to use a stationary bicycle device for 20 minutes and then use a treadmill for 30 minutes. Generally, each device is expensive; therefore putting together a diverse athletic facility in ones home can be costly.

It is common in a public gym to have many devices so that the users can workout on the various devices and stimulate different groups of muscles. However in a public gym devices might be occupied so that a person might be forced to wait when changing from one device to another. Additionally, more devices require more space even if one device is popular and another is hardly used.

Accordingly it would be desirable if a user could perform various motion patterns with the same device thus generally saving space, time and cost.

SUMMARY OF THE INVENTION

An aspect of an embodiment of the invention, relates to a system and method for designing a multimode exercise device that allows various motion contours to be performed by a user's feet. The user can select between two, three or more different motion contours, wherein the contours are circular or elliptical with varying radii. The motions of both of the user's feet are synchronized so that they both move together and finish a cycle together. Optionally the exercise device is set so that both feet are at opposite positions in the cycle, for example one side is down when the other is up or one side moves the user's foot forward when the other foot is moving backward. Alternatively, both feet may be in the same position in the cycle or with a constant variance between both feet.

In some embodiments of the invention, the exercise device causes both feet to perform the same motion, for example both feet perform circular motion or elliptical motion with the same radii. Alternatively, each side may be performing different motion in synchronism, for example one performs circular cycles while the other performs elliptical cycles or one performs a large elliptical cycle and the other performs a small elliptical cycle.

In some embodiments of the invention, synchronization between both sides of the exercise device is performed using a timing belt. Alternatively, synchronization between both sides is performed by gears and a telescopic drive shaft that transfers motion from one rotating gear to another whereas the distance between the two gears may vary.

In some embodiments of the invention, the motion is performed by pushing standard bicycle pedals. Alternatively, the pedals are covered with a foot rest that accommodates the entire foot of the user. In some embodiments of the invention, the foot rest is configured to remain parallel to the ground throughout the entire motion cycle.

There is thus provided according to an exemplary embodiment of the invention, a multimode exercise device, including:

- a chassis with two opposing elongated sides;
- an exercise mechanism mounted onto the chassis including on each side of the chassis:
  - a slidable assembly that is configured to move backward and forward along one elongated side of the chassis;
  - a rotatable wheel configured to rotate about an axis at its center and mounted on the slidable assembly;
  - a pedal coupled to the rotatable wheel configured to rotate the rotatable wheel;
  - a restraining rod that is rotatably coupled to a side of the chassis on a first end and rotatably coupled to the rotatable wheel at one of a plurality of user selectable attachment positions on the second end;
  - a synchronizing mechanism to synchronize between the rotations of the rotatable wheels on both sides of the chassis.

In an exemplary embodiment of the invention, the multimode exercise device includes a crankshaft attached to the axis at the center of the rotatable wheel on one side and attached to the pedal on the other side.

Optionally, the multimode exercise device includes a positioning adapter to couple the pedal to the rotatable wheel; wherein the positioning adapter includes:

a first gear with an axis coinciding with the axis of the rotatable wheel and configured to rotate with the rotatable wheel;

a second gear;

a third gear with the pedal configured to rotate with the third gear;

wherein the second gear is configured to transmit the rotation of the first gear to the third gear and vice versa.

In an exemplary embodiment of the invention, the multimode exercise device includes a selection bar attached to the rotatable wheel; wherein the attachment positions are located on the bar.

Optionally, one of the attachment positions coincides with the center of the rotatable wheel and causes the pedal to perform circular motion when selected.

In an exemplary embodiment of the invention, one of the attachment positions is offset relative to the center of the rotatable wheel and causes the pedal to perform elliptical motion when selected.

Optionally, different attachment positions that are offset relative to the center of the rotatable wheel cause the pedal to perform elliptical motion of varying size.

In an exemplary embodiment of the invention, both sides are configurable to perform the same motion contour simultaneously.

Optionally, both sides are configurable to perform a different motion contour simultaneously.

In an exemplary embodiment of the invention, the multimode exercise device includes a timing belt to synchronize between both sides of the device.

Optionally, the multimode exercise device includes on each side of the chassis:

a drive gear coupled to the rotatable wheel and configured to rotate with the rotatable wheel;

a telescopic drive shaft coupled to the drive gear for passing on the motion of the rotatable wheel;

a synchronization gear that receives the motion of the rotatable wheel via the telescopic drive shaft and is intermeshed with the synchronization gear of the other side to synchronize between the motion of the rotatable wheels on both sides of the chassis.

In an exemplary embodiment of the invention, the drive gear is positioned with an angle of 90° relative to the rotatable wheel.

There is further provided according to an exemplary embodiment of the invention, a method of preparing a multimode exercise device, including:

mounting an exercise mechanism onto a chassis with two opposing elongated sides;

wherein the exercise mechanism on each side of the chassis comprises:

- a slidable assembly that is configured to move backward and forward along one elongated side of the chassis;
- a rotatable wheel configured to rotate about an axis at its center and mounted onto the slidable assembly;
- a pedal coupled to the rotatable wheel configured to rotate the rotatable wheel;
- a restraining rod that is rotatably coupled to a side of the chassis on a first end and rotatably coupled to the rotatable wheel at one of a plurality of user selectable attachment positions on the second end; and
- a synchronizing mechanism to synchronize between the rotations of the rotatable wheels on both sides of the chassis.

In an exemplary embodiment of the invention, the synchronizing mechanism includes:

a drive gear coupled to the rotatable wheel and configured to rotate with the rotatable wheel;

a telescopic drive shaft coupled to the drive gear for passing on the motion of the rotatable wheel; and a synchronization gear that receives the motion of the rotatable wheel via the telescopic drive shaft and is intermeshed with the synchronization gear of the other side to synchronize between the motion of the rotatable wheels on both sides of the chassis.

BRIEF DESCRIPTION OF THE DRAWINGS

The present invention will be understood and better appreciated from the following detailed description taken in conjunction with the drawings. Identical structures, elements or parts, which appear in more than one figure, are generally labeled with the same or similar number in all the figures in which they appear, wherein.

and

Figure 9:
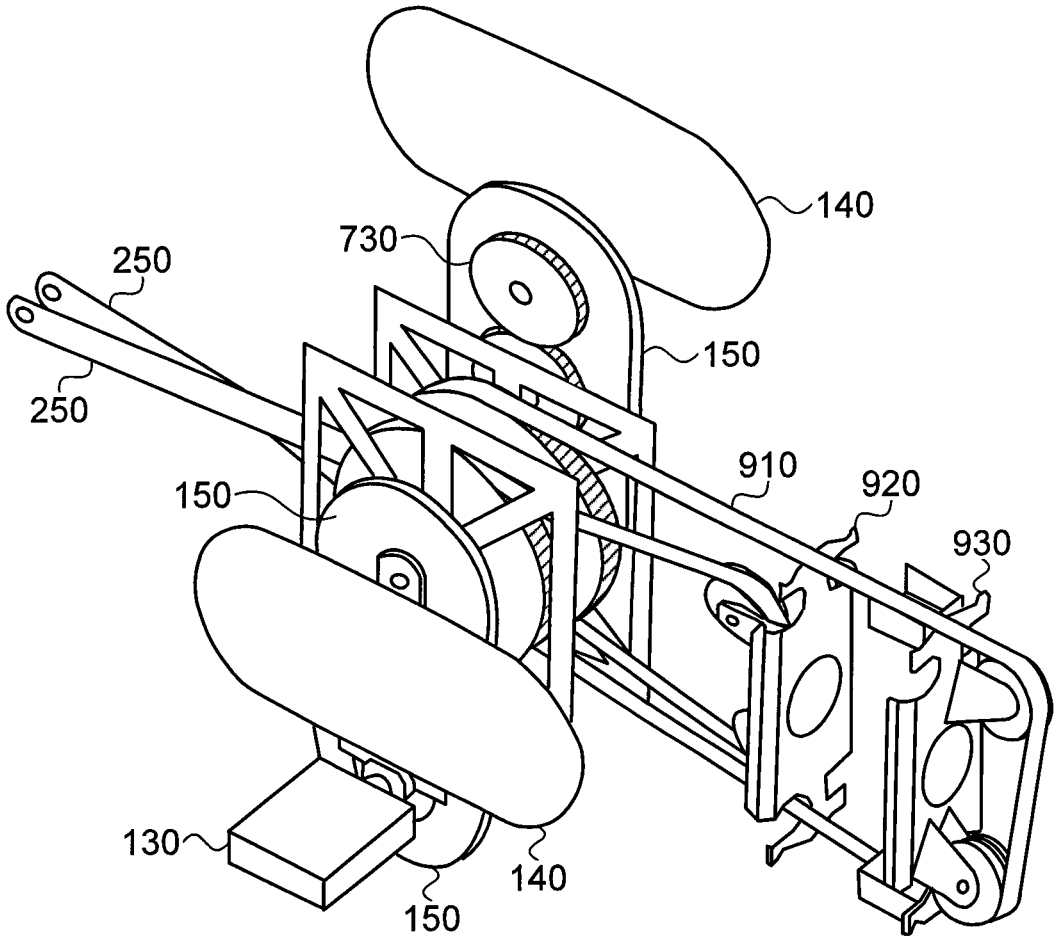

FIG. 9 is a schematic illustration of an alternative synchronizing mechanism between two sides of an exercise mechanism of a multimode exercise device, according to an exemplary embodiment of the invention.

DETAILED DESCRIPTION

Figure 1:
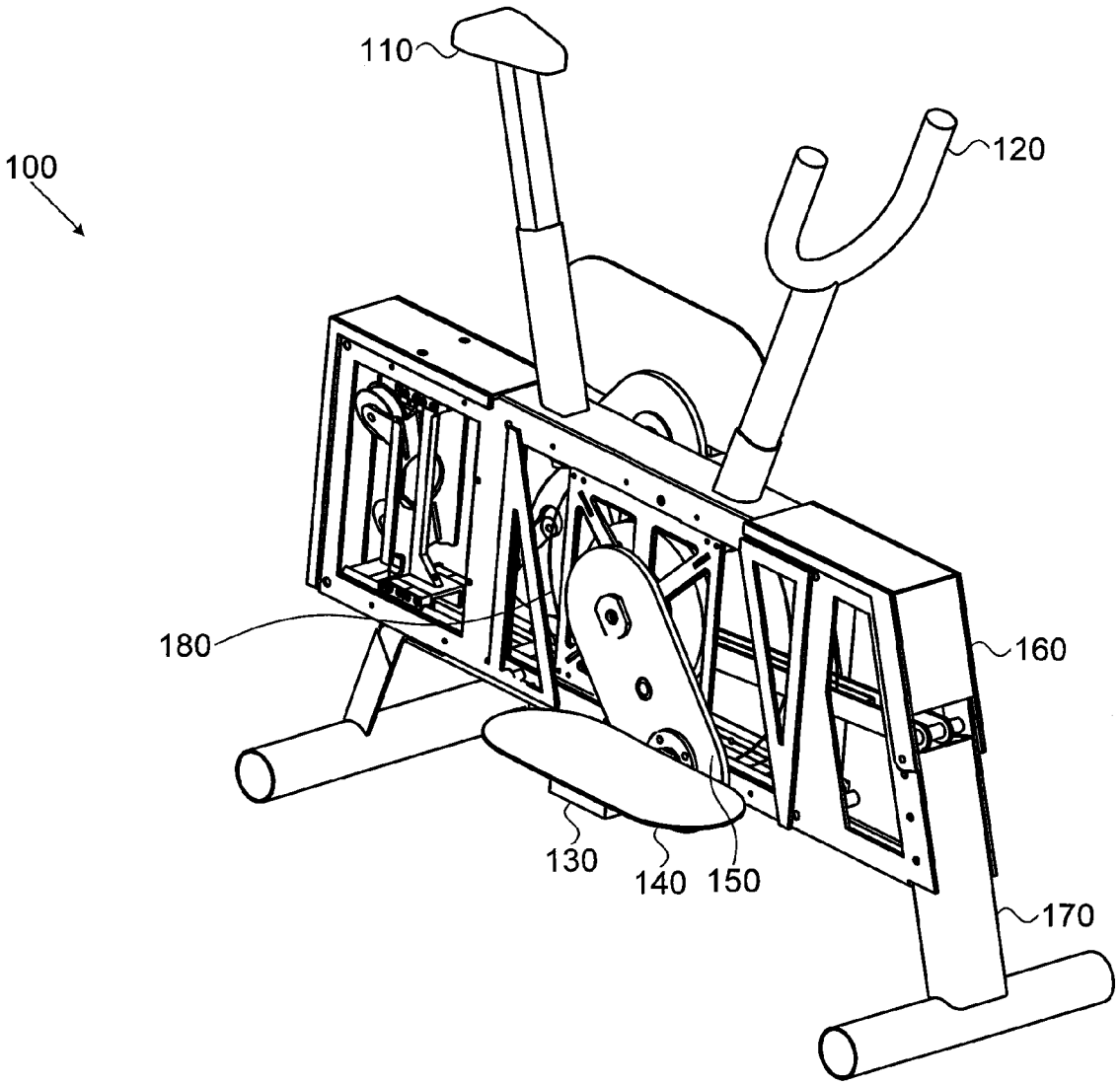
FIG. 1 is a schematic illustration of a multimode exercise device, according to an exemplary embodiment of the invention.

FIG. 1 is a schematic illustration of a multimode exercise device 100, according to an exemplary embodiment of the invention. In an exemplary embodiment of the invention, multimode exercise device 100 is designed as a stationary bicycle with a seat 110, handlebars 120, pedals 130, and a chassis 160 mounted on legs 170. Optionally, chassis 160 encases an exercise mechanism 180 that is selectively configured to enable a user to pedal, with the motion of the user's feet on the pedals 130 forming various shaped contours. In an exemplary embodiment of the invention, in one setting the pedals 130 move in a circular contour and in a different setting the pedals 130 move in various sized elliptical shaped contours, depending on the settings of multimode exercise device 100.

In an exemplary embodiment of the invention, the pedals 130 on both sides of multimode exercise device 100 are coupled together by exercise mechanism 180 so that they move together synchronously while moving in the selected shaped contour.

Figure 2:
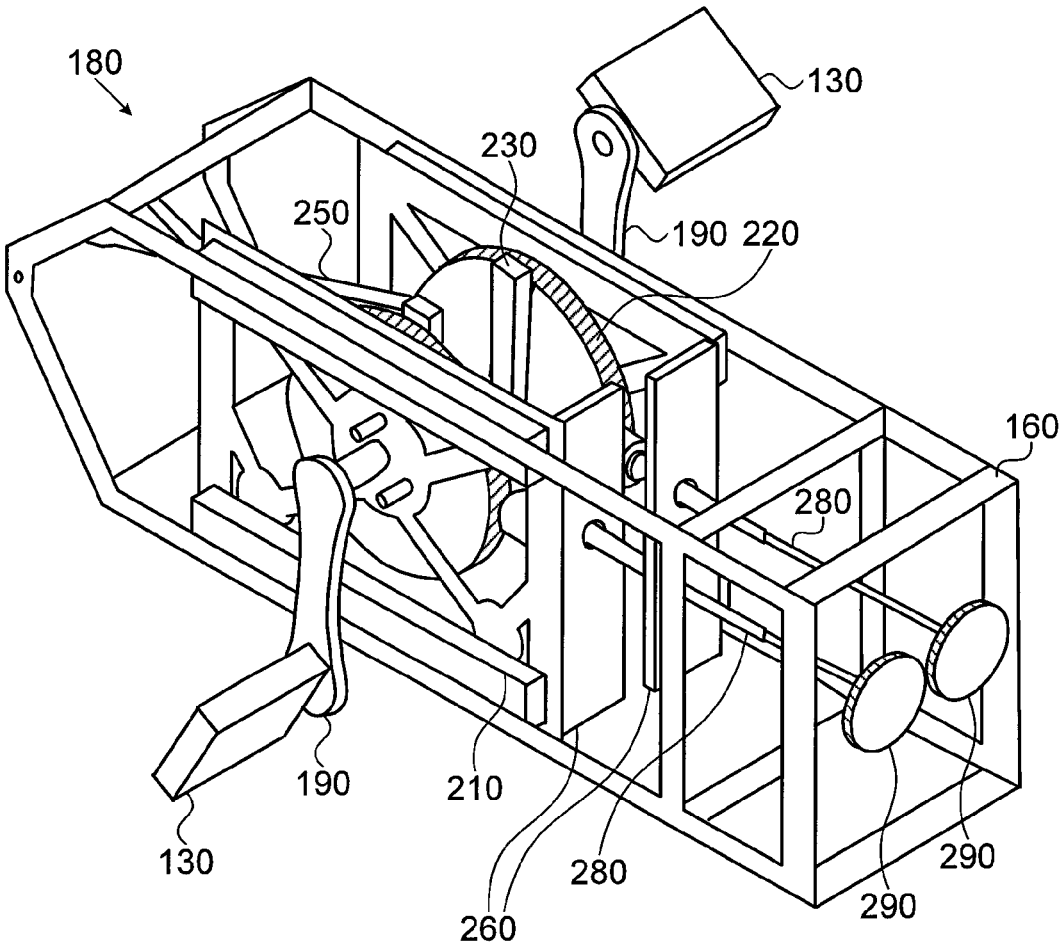
FIG. 2 is a schematic illustration of a perspective view of the chassis of a multimode exercise device, according to an exemplary embodiment of the invention.

In some embodiments of the invention, pedals 130 are connected to exercise mechanism 180 with a standard crank shaft (190 illustrated in FIG. 2). Alternatively, pedals 130 are connected to exercise mechanism 180 with a positioning adapter 150 that replaces crank shaft 190 and controls the angular position of the pedals 130 so that they will be held parallel to the floor while the pedals move around a central axis. Optionally a foldable foot rest 140 is attached to positioning adapter 150 so that it covers pedal 130 and supports the user's foot with an area larger than the size of the pedals 130. Alternatively, it can be folded up so that the user's foot will rest on pedal 130.

Figure 3:
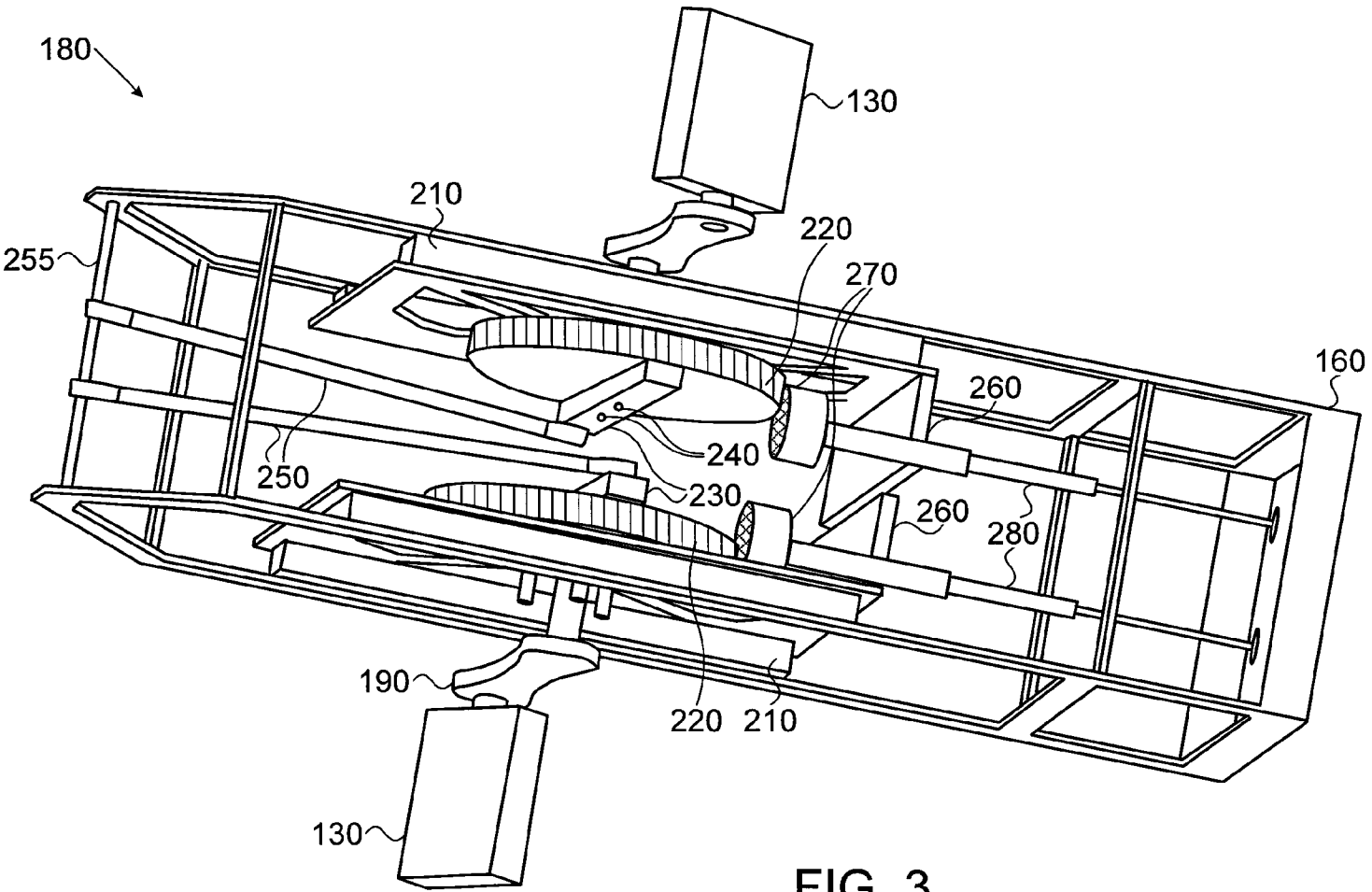
FIG. 3 is a schematic illustration of a top view of the chassis of a multimode exercise device, according to an exemplary embodiment of the invention.
Figure 4:
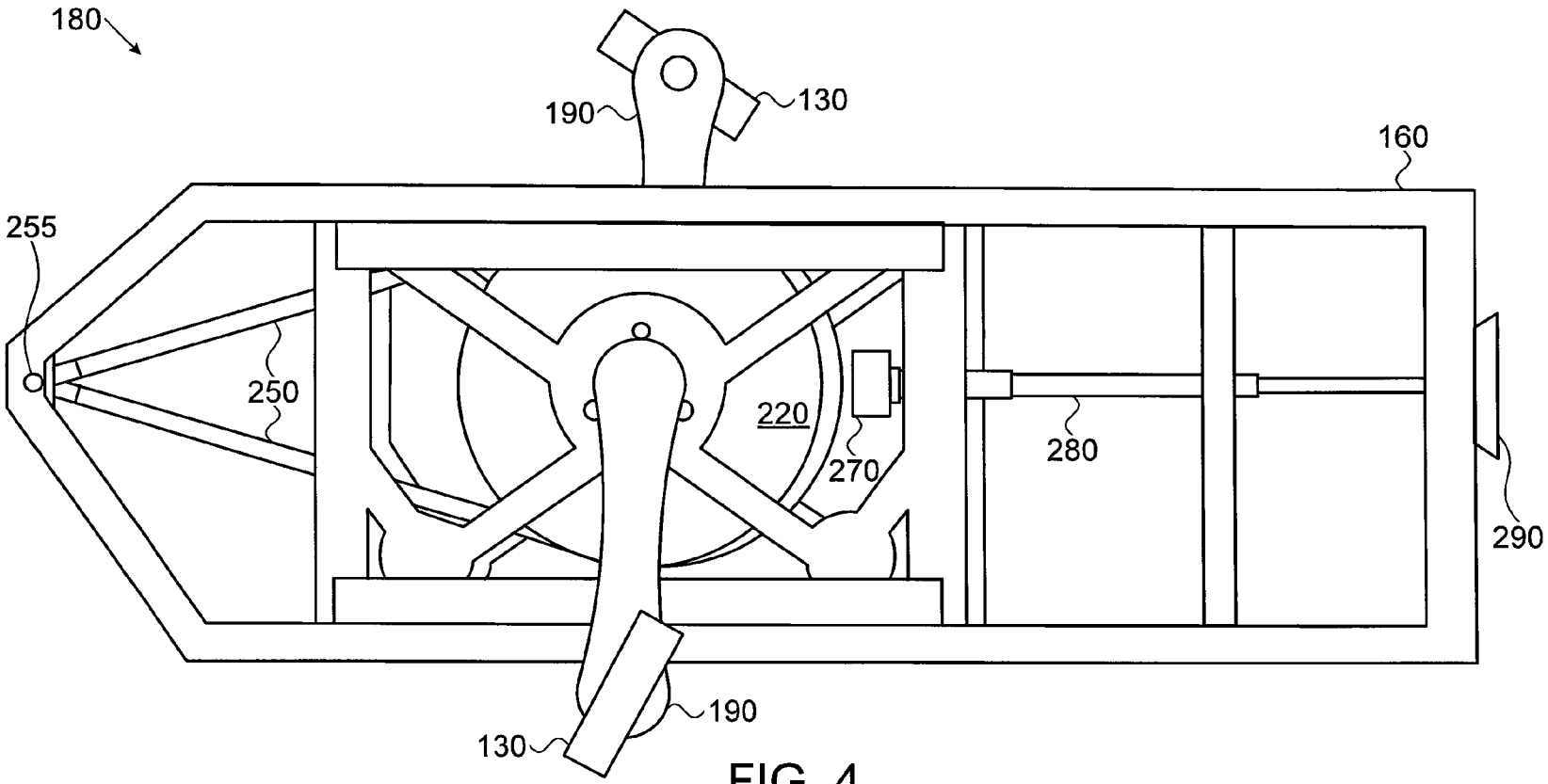
FIG. 4 is a schematic illustration of a side view of the chassis of a multimode exercise device, according to an exemplary embodiment of the invention.

FIGS. 2, 3 and 4 are schematic illustrations of various views of the chassis 160 of multimode exercise device 100, according to an exemplary embodiment of the invention. In an exemplary embodiment of the invention, exercise mechanism 180 is situated inside chassis 160 and includes a right side and a left side with mirror copies of the same elements to function in the same manner. Both sides are coupled together by a synchronizing mechanism to synchronize between them.

In an exemplary embodiment of the invention, each side includes a slidable assembly 210 that is adapted to slide back and forth along the length of the elongated side of chassis 160. Additionally, a wheel 220 is mounted onto slidable assembly 210. Wheel 220 is connected to crank shaft 190 so that when a user turns the pedals 130 of multimode exercise device 100 the crank shaft 190 turns wheel 220.

In an exemplary embodiment of the invention, the inner sides of wheels 220 are coupled to a selection bar 230 that include a few attachment positions 240 for attaching a restraining rod 250. The restraining rod 250 is fastened on one side to a beam 255 that affixes the motion of restraining rod 250. On the other side restraining rod 250 is connected to one of the attachment positions 240 on selection bar 230 according to the selection of the user. In some embodiments of the invention, the attachment positions may be selected automatically by an automated selection mechanism so that the user does not need to access exercise mechanism 180 directly, and the selection may be performed by a computer or other means.

In an exemplary embodiment of the invention, one of the attachment positions 240 is at the center of wheel 220 to cause pedals 130 to move forming circular motion. Additionally selection bar 230 includes one or more additional attachment positions 240 that are situated off-center so that pedals 130 will move forming elliptical motion.

Optionally, the attachment positions 240 on one side of exercise mechanism 180 are situated from the rotation axis of wheel 220 toward the opposite direction as on the other side of exercise mechanism 180, so that when one pedal is up the other is down and vice versa. Alternatively or additionally, selection bar 230 may have attachment positions 240 toward both sides of wheel 220 so that the pedals 130 may be situated freely according to the user's selection, for example both pedals 130 in the same direction (e.g. both pedals upward or downward). In some embodiments of the invention, attachment positions 240 are positioned directly on wheel 220 instead of on selection bar 230.

In an exemplary embodiment of the invention, slidable assembly 210 includes a back panel 260 that supports a gear 270 that is positioned at 90° relative to wheel 220 and is configured to move with wheel 220. Optionally, gear 270 is connected with a telescopic drive shaft 280 to synchronizing gears 290. In an exemplary embodiment of the invention, when wheel 220 on one side of exercise mechanism 180 is rotated it transfer the rotational motion to gear 270. Gear 270 transfers the motion via telescopic drive shaft 280 to synchronizing gear 290. synchronizing gear 290 transfers the motion to the synchronizing gear 290 of the other side that transfer the motion to gear 270 of the other side via the telescopic drive shaft 280 of the other side. Gear 270 on the other side transfers the motion to wheel 220 on the other side so that both wheels 220 move together synchronously.

In an exemplary embodiment of the invention, when both wheels 220 are selected to perform circular motion slidable assembly 210 remains stationary and telescopic drive shaft 280 does not need to expand or contract. However if one side or both sides are set to form elliptical motion telescopic drive shaft 280 expands and/or contracts to compensate for the positions of slidable assemblies 210, so that gears 270 and synchronizing gears 290 will transfer the rotational motion from one to the other.

Figure 5:
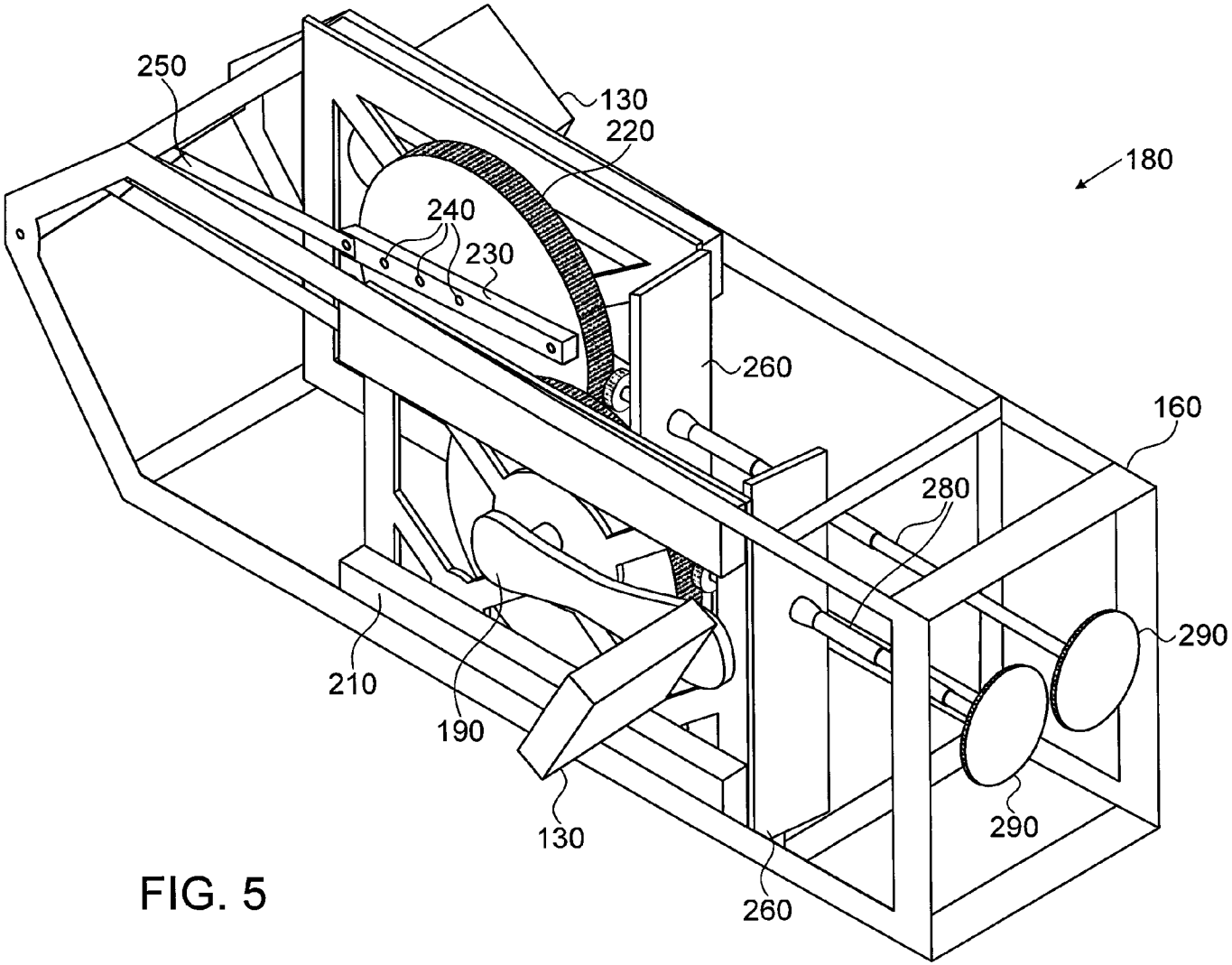
FIG. 5 is a schematic illustration of a perspective view of an exercise mechanism of a multimode exercise device in a first position, according to an exemplary embodiment of the invention.
Figure 6:
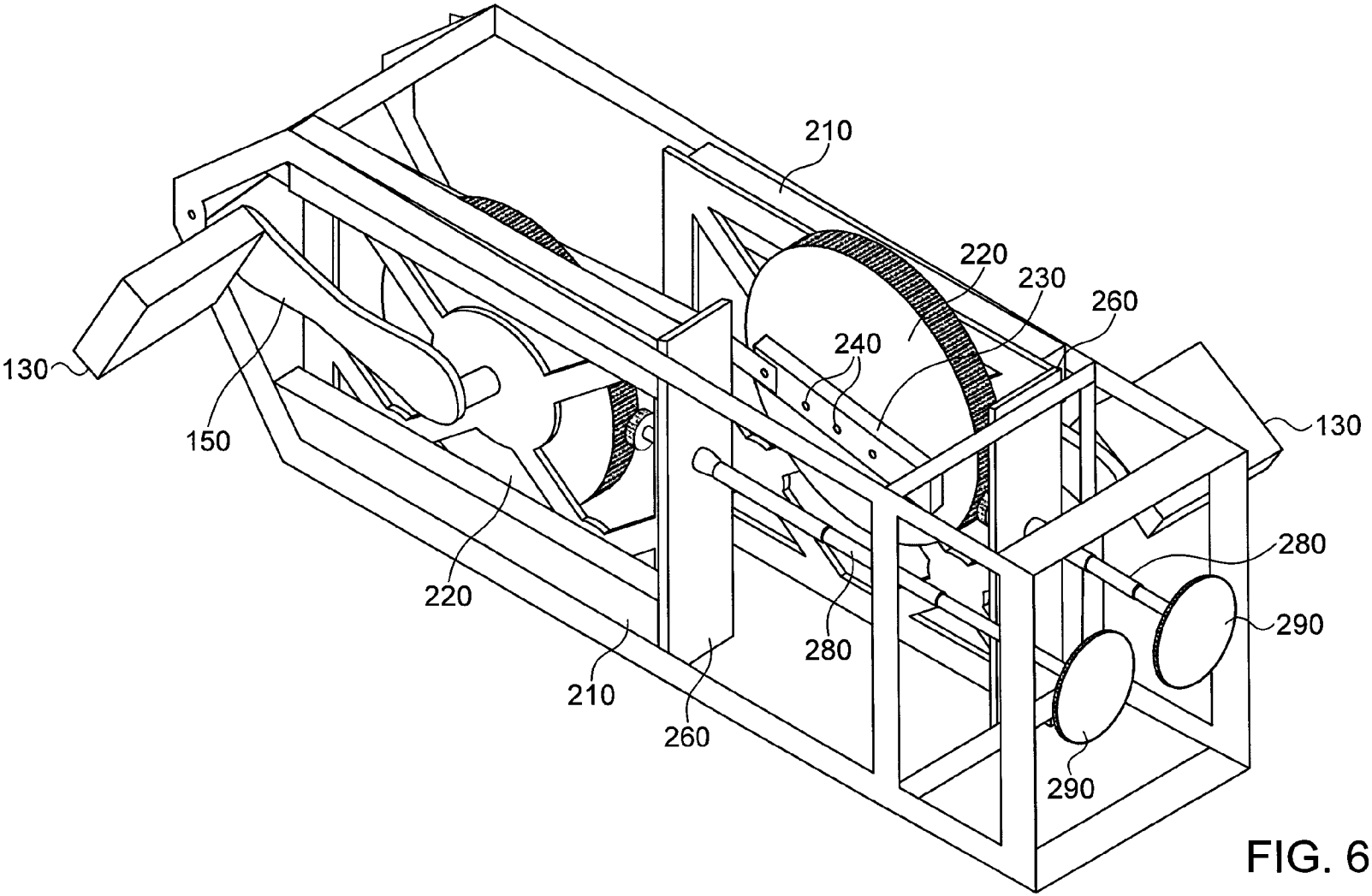
FIG. 6 is a schematic illustration of a perspective view of an exercise mechanism of a multimode exercise device in a second position, according to an exemplary embodiment of the invention.

FIGS. 5 and 6 are schematic illustrations of a perspective view of the exercise mechanism 180 of multimode exercise device 100 in two different positions, according to an exemplary embodiment of the invention. in an exemplary embodiment of the invention, when any side of exercise mechanism 180 is set to perform elliptical motion slidable assembly 210 will move along chassis 160 under the constraint of restraining rod 250. Optionally, each side can move freely forward or backward without dependence on the other side. The synchronization system including gears 270, telescopic drive shaft 280 and synchronizing gears 290 deal with synchronizing the motion between both sides of the exercise mechanism. In an exemplary embodiment of the invention, the synchronization assures that the pedals 130 will move together, for example to assure that pedal 130 on one side will be up while the other is down or one pedal 130 will be at the far right when the other pedal 130 is at the far left. Optionally, the user can select other attachment positions 240 on selection bar 230 with restraining rod 250, so that both pedals 130 will be down or both pedal 130 will be up at the same time if so desired. In some embodiments of the invention the user needs to move his body with the strength of his hands since the pedals 130 might be set in a position that makes it hard to control them only with the strength of one's feet.

Optionally, both sides of exercise mechanism 180 are set so that the pedals perform the same contour of motion. However in some embodiments of the invention each side of exercise mechanism 180 may perform a different motion pattern by attaching restraining rod 250 to non symmetric attachment positions 240 on selection bar 230, for example by attaching restraining rod 250 on the right side of exercise mechanism 180 to the center of wheel 220 and the left side of exercise mechanism 180 to the attachment position furthest away from the center. As a result the right side will perform circular motion while the left side will perform a large elliptical motion. Optionally, the synchronization system will keep the pedals 130 synchronized.

Figure 7:
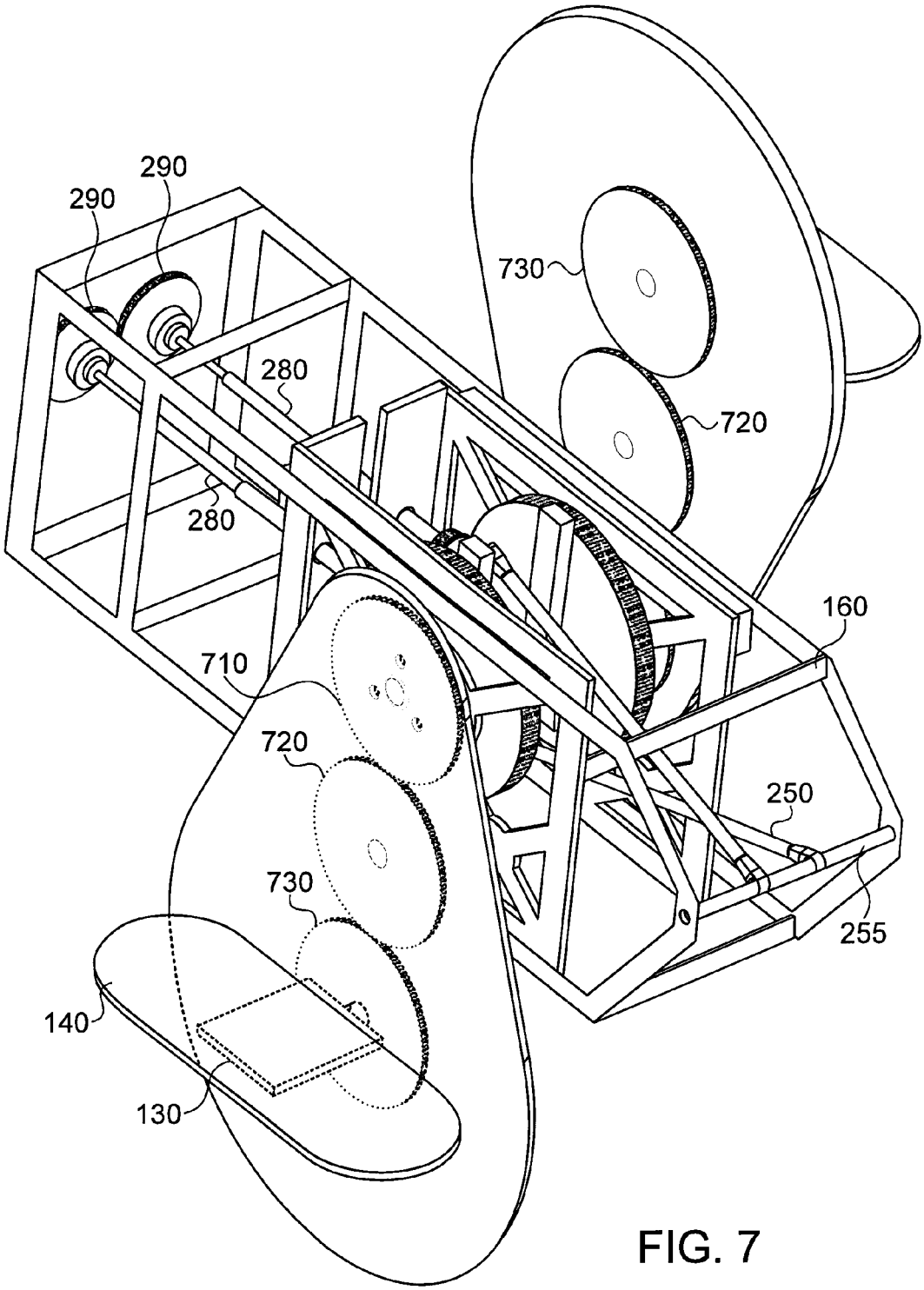
FIG. 7 is a schematic illustration of an alternative pedal mechanism for use with a multimode exercise device, according to an exemplary embodiment of the invention.

FIG. 7 is a schematic illustration of an alternative pedal mechanism for use with multimode exercise device 100, according to an exemplary embodiment of the invention. In some embodiments of the invention crank shaft 190 is replaced with positioning adapter 150. Optionally, positioning adapter 150 includes three gears: a first gear 710 rotates around the axis which wheel 220 rotates. The third gear 730 is coupled to positioning adapter 150 and pedal 130 is attached to its axis. The second gear 720 is coupled to positioning adapter 150 and positioned between the first gear 710 and the third gear 730 to synchronize between them and cause pedal 130 to always be positioned parallel to the ground regardless of where it is positioned in its cycle around the axis of wheel 220.

In some embodiments of the invention, foldable foot rest 140 is coupled to positioning adapter 150 and can be folded down above pedal 130 so that the user's foot will be completely supported, in contrast to pedal 130 which only supports the center of the user's foot.

Figure 8A:
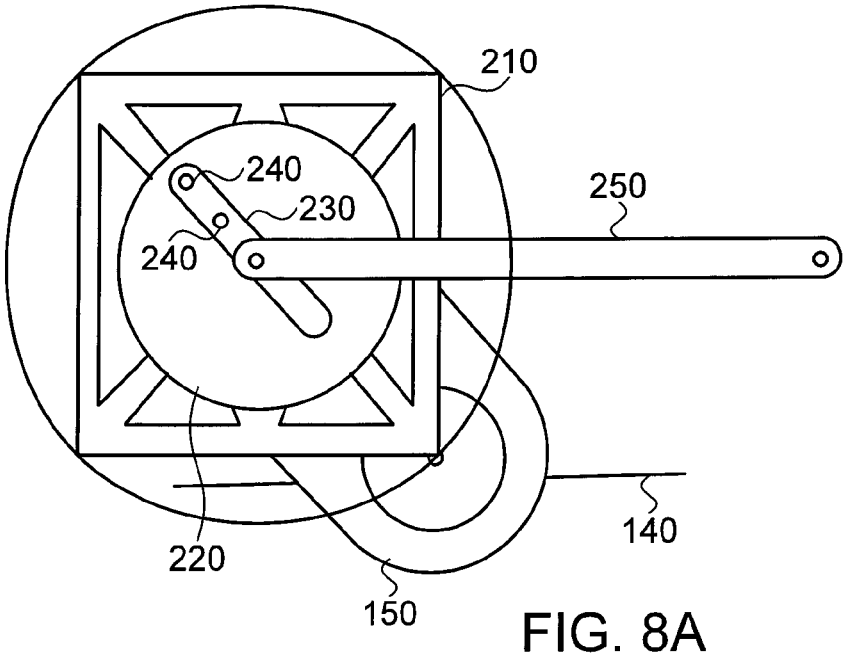
FIG. 8A is a schematic illustration exemplifying circular pedal motion using an exercise mechanism of a multimode exercise device, according to an exemplary embodiment of the invention.
Figure 8B:
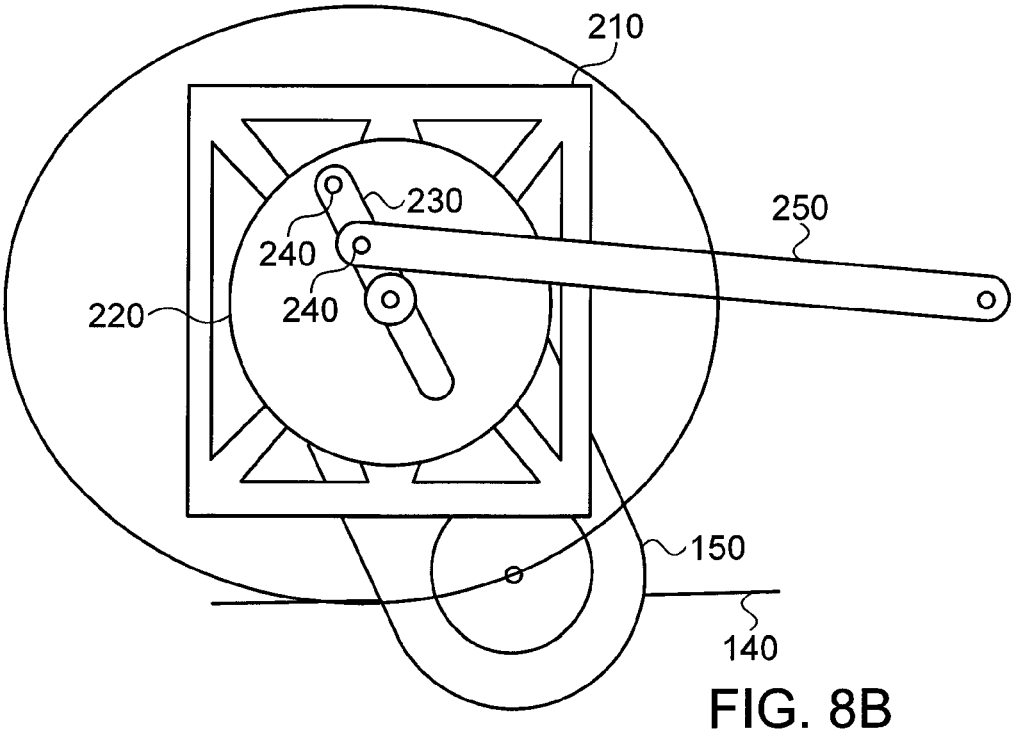
FIG. 8B is a schematic illustration exemplifying small elliptical pedal motion using an exercise mechanism of a multimode exercise device, according to an exemplary embodiment of the invention.
Figure 8C:
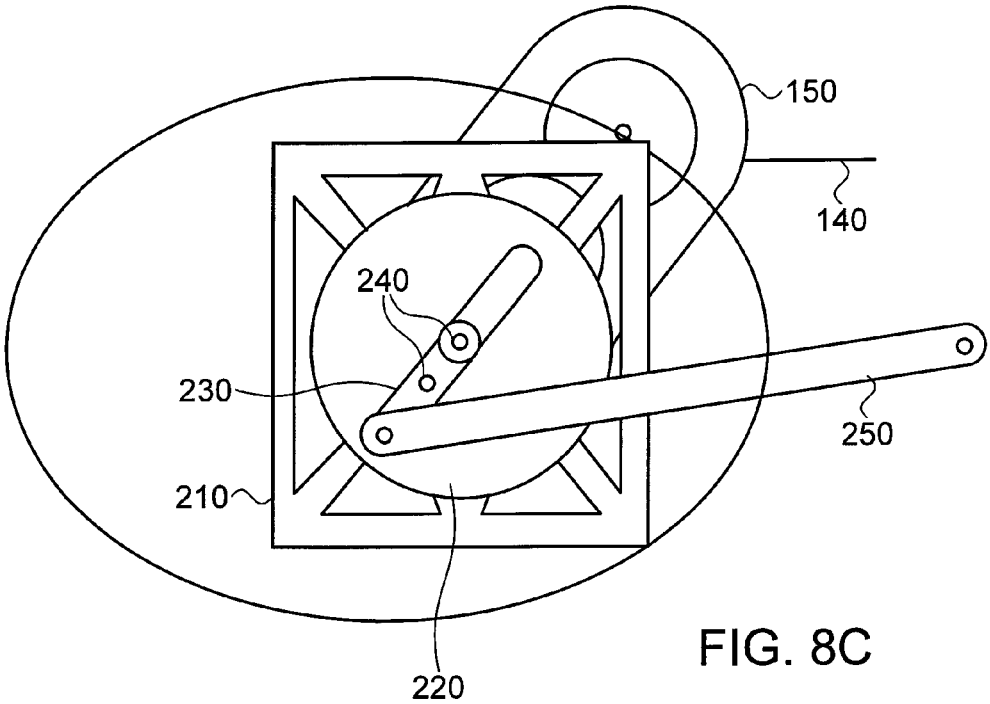
FIG. 8C is a schematic illustration exemplifying large elliptical pedal motion using an exercise mechanism of a multimode exercise device, according to an exemplary embodiment of the invention.

FIGS. 8A-8C are schematic illustrations exemplifying various pedal motion contours using exercise mechanism 180 of multimode exercise device 100, according to an exemplary embodiment of the invention. In an exemplary embodiment of the invention, in FIG. 8A restraining rod 250 is attached to selection bar 230 at an attachment position 240 that coincides with the center axis of wheel 220. As a result the axis of gear 730 (where pedal 130 and foot rest 140 are attached) will form a circular motion contour.

In an exemplary embodiment of the invention, in FIG. 8B restraining rod 250 is attached to selection bar 230 at an attachment position 240 that is further out from the center of wheel 220. As a result the axis of gear 730 (where pedal 130 and foot rest 140 are attached) will form a small elliptical motion contour.

In an exemplary embodiment of the invention, in FIG. 8C restraining rod 250 is attached to selection bar 230 at an attachment position 240 that is further away from the center of wheel 220 than in FIG. 8B. As a result the axis of gear 730 (where pedal 130 and foot rest 140 are attached) will form a large elliptical motion contour.

Figure 8D:
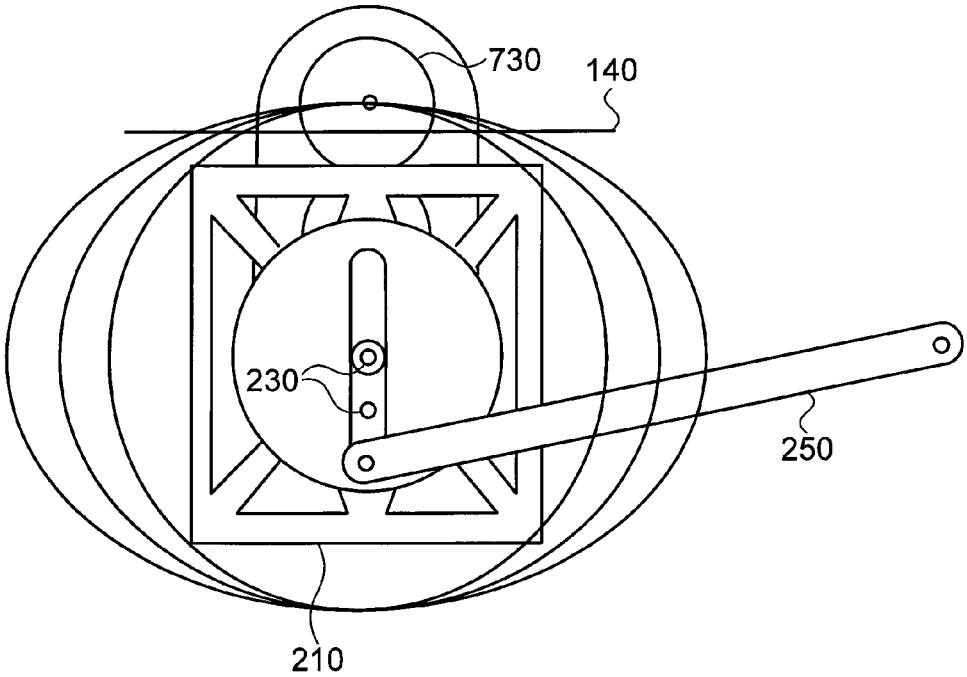
FIG. 8D is a schematic illustration exemplifying a comparison between multiple pedal contours using an exercise mechanism of a multimode exercise device, according to an exemplary embodiment of the invention.

FIG. 8D is a schematic illustration exemplifying a comparison between the motion contours formed by attaching restraining rod 250 to various attachment positions 240 on selection bar 230. Accordingly, the user of multimode exercise device 100 can select the mode of motion of the pedals 130 by selecting an attachment position 240.

In some embodiments of the invention, selection bar 230 may have only two attachment positions 240, to select circular or elliptical motion. Alternatively, selection bar 230 may have three attachment positions 240 or more to select circular motion and elliptical motion of varying radii.

In some embodiments of the invention, selection bar 230 has attachment positions 240 only on one side of selection bar 230 relative to the central axis to limit the position of pedals 130 on both sides of exercise mechanism 180 to be in opposite direction from one another (e.g. so that when one is up the other is down and vice versa). Alternatively, selection bar 230 may have attachment positions 240 along its entire length, so that the user can select any combination of attachment positions 240 on either side of exercise mechanism 180.

FIG. 9 is a schematic illustration of an alternative synchronizing mechanism between the two sides of exercise mechanism 180 of multimode exercise device 100, according to an exemplary embodiment of the invention. In an exemplary embodiment of the invention, instead of coupling wheel 220 to gears 270 as described above a timing belt 910 is wrapped around wheels 220 and a stationary set of pulley wheels 920 and a moveable set of pulley wheels 930. Optionally, the timing belt 910 with the help of pulley wheels 920 and pulley wheels 930 transfers the motion of wheel 220 on one side of exercise mechanism 180 to wheel 220 on the other side of exercise mechanism 180. Optionally, the movable set of pulley wheels 930 are held in place with springs (not shown) relative to chassis 160 so that they can move forward and backward responsive to the motion of slideable assembly 210 on either side of exercise mechanism 180.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the invention. Further combinations of the above features are also considered to be within the scope of some embodiments of the invention.

It will be appreciated by persons skilled in the art that the present invention is not limited to what has been particularly shown and described hereinabove. Rather the scope of the present invention is defined only by the claims, which follow.

The invention claimed is:

1. A multimode exercise device, comprising:

a chassis with two opposing elongated sides;

an exercise mechanism mounted onto the chassis comprising on each side of the chassis:

a slidable assembly that is configured to move backward and forward along one elongated side of the chassis;

a rotatable wheel configured to rotate about an axis at its center and mounted onto the slidable assembly;

a pedal coupled to the rotatable wheel configured to rotate the rotatable wheel;

a restraining rod that is rotatably coupled to a side of the chassis on a first end and rotatably coupled to the rotatable wheel at one of a plurality of user selectable attachment positions on the second end; and a synchronizing mechanism to synchronize between the rotations of the rotatable wheels on both sides of the chassis; and wherein each side of the chassis further comprises:

a drive gear coupled to the rotatable wheel and configured to rotate with the rotatable wheel;

a telescopic drive shaft coupled to the drive gear for passing on the motion of the rotatable wheel; and a synchronization gear that receives the motion of the rotatable wheel via the telescopic drive shaft and is intermeshed with the synchronization gear of the other side to synchronize between the motion of the rotatable wheels on both sides of the chassis.

2. A multimode exercise device according to claim 1, further comprising a crankshaft attached to the axis at the center of the rotatable wheel on one side and attached to the pedal on the other side.

3. A multimode exercise device according to claim 1, further comprising a selection bar attached to the rotatable wheel; wherein said attachment positions are located on the bar.

4. A multimode exercise device according to claim 1, wherein one of the attachment positions coincides with the center of the rotatable wheel and causes the pedal to perform circular motion when selected.

5. A multimode exercise device according to claim 1, wherein one of the attachment positions is offset relative to the center of the rotatable wheel and causes the pedal to perform elliptical motion when selected.

6. A multimode exercise device according to claim 1, wherein different attachment positions that are offset relative to the center of the rotatable wheel cause the pedal to perform elliptical motion of varying size.

7. A multimode exercise device according to claim 1, wherein both sides are configurable to perform the same motion contour simultaneously.

8. A multimode exercise device according to claim 1, wherein both sides are configurable to perform a different motion contour simultaneously.

9. A multimode exercise device according to claim 1, wherein said drive gear is positioned with an angle of 90° relative to the rotatable wheel.

10. A method of preparing a multimode exercise device, comprising:

mounting an exercise mechanism onto a chassis with two opposing elongated sides;

wherein the exercise mechanism on each side of the chassis comprises:

a slidable assembly that is configured to move backward and forward along one elongated side of the chassis;

a rotatable wheel configured to rotate about an axis at its center and mounted onto the slidable assembly;

a pedal coupled to the rotatable wheel configured to rotate the rotatable wheel;

a restraining rod that is rotatably coupled to a side of the chassis on a first end and rotatably coupled to the rotatable wheel at one of a plurality of user selectable attachment positions on the second end; and a synchronizing mechanism to synchronize between the rotations of the rotatable wheels on both sides of the chassis, wherein the synchronizing mechanism further comprises:

a drive gear coupled to the rotatable wheel and configured to rotate with the rotatable wheel;

a telescopic drive shaft coupled to the drive gear for passing on the motion of the rotatable wheel; and a synchronization gear that receives the motion of the rotatable wheel via the telescopic drive shaft and is intermeshed with the synchronization gear of the other side to synchronize between the motion of the rotatable wheels on both sides of the chassis.

* * * * *